US006290451B1

(12) United States Patent
Ihm

(10) Patent No.: US 6,290,451 B1
(45) Date of Patent: Sep. 18, 2001

(54) UTILITY IMPLEMENT PROJECTION AND RETRACTION ASSEMBLY

(76) Inventor: Jason Tory Ihm, 10342 Cty ID, Blue Mounds, WI (US) 53517

( * ) Notice: Subject to any disclaimer, the term of this patent is extended or adjusted under 35 U.S.C. 154(b) by 0 days.

(21) Appl. No.: 09/353,272

(22) Filed: Jul. 14, 1999

(51) Int. Cl.[7] ..... B66F 9/12

(52) U.S. Cl. ..... 414/722; 414/24.5; 414/724; 414/912

(58) Field of Search ..... 414/722, 724, 414/725, 912, 24.5, 24.6

(56) References Cited

U.S. PATENT DOCUMENTS

| | | | |
|---|---|---|---|
| D. 141,948 | 8/1945 | Michaels | D39/1 |
| D. 361,772 | 8/1995 | Hulsey | D15/32 |
| 2,419,493 | 4/1947 | Hoff | 214/140 |
| 2,446,827 | 8/1948 | Hall | 214/146 |
| 2,496,563 | 2/1950 | Siems | 214/145 |
| 2,612,280 | 9/1952 | Stueland | 214/145 |
| 2,652,939 | 9/1953 | Burch | 214/140 |
| 2,868,399 | 1/1959 | Fortier | 214/140 |
| 3,325,023 | 6/1967 | Coleman | 37/141 |
| 3,349,933 | 10/1967 | Simpson | 37/141 |
| 3,706,388 | 12/1972 | Westendorf | 214/145 |
| 3,795,331 | 3/1974 | Guest | 214/145 |
| 3,834,567 | 9/1974 | Miller | 214/145 |
| 3,908,844 | 9/1975 | Duffield | 214/145 |
| 3,921,837 | 11/1975 | Vandewater | 214/145 |
| 4,275,985 | 6/1981 | Schremmer | 414/722 |
| 5,603,382 * | 2/1997 | McIver | 414/725 X |
| 5,984,606 * | 11/1999 | Meeks | 414/912 X |

* cited by examiner

*Primary Examiner*—Donald W. Underwood
(74) *Attorney, Agent, or Firm*—Loyd W. Bonneville

(57) ABSTRACT

A hydraulically operated framework which permits certain farm or construction accessories, including an array of spears or a squeegee, to be employed at the front of a utility vehicle's loading bucket and afterwards withdrawn out of the way into the bucket.

10 Claims, 6 Drawing Sheets

UTILITY IMPLEMENT PROJECTION AND RETRACTION ASSEMBLY

BACKGROUND OF THE INVENTION

1. Field of the Invention

Farm equipment; construction equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term sector channel guide (8) might be used in one instance but in another, if meaning is otherwise clear from context, expression might be shortened to channel guide (8) or merely guide (8). Any of those forms is intended to convey the same meaning.

The term attach or fasten or any of their forms when so used means that the juncture is of a more or less permanent nature, such as might be accomplished by nails, screws, welds or adhesives. Thus, it is stated herein that the piston rod (9) is attached to the moveable frame (1). A connection in which one object is easily removed from another would, if relevant herein, be described by the word emplace. Employment of the words connector join or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, an extender (4) may be said to comprise a scraper support (24), meaning that in the particular case, the extender (4) is a scraper support (24). However, the word comprise may also be used to describe a feature which is part of the structure or composition of a given element. Thus, a hydraulic piston cylinder (2) may be said to comprise a piston rod (9), meaning that the structure of the cylinder (2) is such as to have the piston rod (9) as a feature of its structure. The meaning in the respective cases is clear from context, however. Accordingly, modifying words to clarify which of the two uses is the intended one seem unnecessary.

The words forward or rearward and root variations thereof are intended to designate the situs of an object described with reference to the orientation of the operator of a given utility vehicle. Thus, when a spear (14) is discussed in terms of frontal attachment or forward movement, reference is intended to be consistent with the direction the front of the vehicle (100) points as well as that in which the operator faces while driving it (100).

The word multiply may connote either of two intended meanings. Its use as a verb is, of course, well known. However, when employed herein as an adjective, it denotes plurality, such as the expression multiply arrayed spears (14).

In both farming and construction, it is occasionally useful to have the capability of grasping substantially sized bundles or masses of hay, manure or similar materials and moving them about with a utility vehicle (100) of one sort or another. For such use, forward projecting tines or spears (14) may be employed. It is also useful to have the capability of lowering an elastic scraper (23) and moving it (23) along a floor for cleaning purposes in the fashion of a squeegee. Operations of both sorts at first depended upon certain operable linkages mechanical in nature—such as chains, wires and booms—but ultimately were made to rely upon hydraulic systems.

The loading bucket (101) itself is extremely useful in scooping dirt, gravel, manure or other loose grainy materials; in lifting and transporting substantial volumes of those or other materials; and in digging or gouging operations. It has even become an occasional practice to configure the bottom (104) of the bucket (101), at the front thereof (101), with a chiseled edge (102). Because they are fixed in place so as to present an obstruction, frontal accessories used in prior art generally require that one forego use of the loading bucket (101) for its (101) usual or traditional intended purpose.

A hydraulic system comprises a sealed hydraulic cylinder (2) into which hydraulic oil-like fluid passes to push a piston rod (9) within it (2) along its (2) length and beyond so as to accomplish necessary work. The piston rod (9) is designed, of course, to remain anchored or stopped within the cylinder (2) so that it does not fall out of it (2) when extended. Moreover, such configuration provides a fixed limit to the maximum distance the piston rod (9) extends from the cylinder (2). Operably, however, the piston (9) rod may be made to extend to any intermediate position. Because the hydraulic fluid for all practical purposes retains its volume without compression, the force it exerts can be transmitted a considerable distance through hydraulic feeder lines (3). Variations in cylinder (2) volume can provide within the system mechanical advantage, as that terminology is used in matters of physics.

Especially useful are cylinders (2) which allow the fluid to enter on either side of the piston rod (9) within, thus allowing the piston rod (9) to accomplish work first in a forward direction and then a reverse one, depending upon the particular need. For such a two-way or reciprocal system, as designated herein, a pair of hydraulic feeder lines (3) is, of course, required. Typically, the operator manipulates a hand lever to engage the cylinder (2), causing hydraulic fluid to act through one of the feeder lines (3) and move the cylinder piston rod (9) in the direction selected. To reverse the direction of the piston rod (9) the operator manipulates either a second hand lever or, if the system is so designed, the same one in a reverse manner. A variety of hand controls are known in the art.

Since hydraulic systems have already become popular as the power mechanisms employed to manipulate a loader bucket in one dimension or another, they would conveniently lend themselves to empower the operations inherent to frontal accessories of the sort discussed herein.

The vehicles with which frontal implements of the sort discussed herein—spears (14) or elastic scrapers (23)—have been employed at prior art might comprise a tractor (100) rigged up with a frontally disposed utility bucket (101) but, more commonly, one generally known as a "front end loader", occasionally dubbed a "skid steer" (100). The vehicle (100) is one whose various powered bucket (101) lifting and tilting is accomplished by the lever manipulated hydraulic mechanisms mentioned supra. Thus, the frontally disposed bucket (101) may be lowered to the ground and pivoted on a horizontal axis such that material is scooped into its (101) cavity; then raised and tipped to dump its (101) contents at a location the loader vehicle (100) has taken it to. Even without employing the bucket (101), material such as hay and manure may be collected on an array of tine-like spears (14) of the sort developed in prior art and moved in similar fashion.

While the multiply arrayed frontal spears (14) and the elastic scrapers (23) of prior art have been useful in their employment, no provision had been made to facilitate conversion to alternative traditional use of the vehicle (100) and bucket (101) de hors that implementation (14, 23). Thus, if the operator, after either using the scraper (23) for cleaning purposes or the spears (14) for transport of a bundle of hay or the like, desired to employ the bucket (101) to which either the spears (14) or scraper (23) was attached, he or she would be obliged to disconnect that implementation (14, 23) from the system and then attach or otherwise connect a simple bucket (101) in its place.

Though not a necessity, it would also be useful if the same mechanism could be used to conveniently alternate between spear (14) arrayal and squeegee operations. It would seem sufficient that the invention provides both a retractable spear (14) arrayal and a retractable squeegee. Separate loading buckets (101) would, respectively, accommodate the two applications. There would, thus, be a first bucket (101) comprising a moveable frame (1) and spear (14) array and a second one (101), an elastic scraper (23). While projectability and retractability of each of those assemblies would seem to be meritworthy on their own, in the further interest of economy, it would be of considerable benefit to allow one to change from spear (14) to squeegee operation without having to disengage one loading bucket (101) to connect to another (101). It would, thus, be useful that the invention repose in an embodiment by which an elastic scraper (23) might be mounted directly upon spears (14).

The following patents comprise mechanisms in which spears (14) employed with a utility vehicle (100) are bolted in place: U.S. Pat. No. Des. 141,9483 issued to Michaels; U.S. Pat. No. 2,419,493 issued to Hoff; U.S. Pat. No. 2,446,827 issued to Hall; U.S. Pat. No. 2,496,563 issued to Siems; U.S. Pat. No. 2,612,280 issued to Stueland; U.S. Pat. No. 3,325,023 issued to Coleman; U.S. Pat. No. 3,349,933 issued to Simpson; U.S. Pat. No. 3,706,388 issued to Westendorf; U.S. Pat. No. 3,834,567 issued to Miller, U.S. Pat. No. 3,921,837 issued to Vandewater; U.S. Pat. No. 4,275,985 issued to Schremmer; and U.S. Pat. No. Des. 361,772 issued to Hulsey.

The following patents comprise mechanisms in which hydraulic power is employed for such functions as, for example, tipping the loading bucket: Hoff, supra; U.S. Pat. No. 2,652,939 issued to Burch; U.S. Pat. No. 2,868,399 issued to Fortier, U.S. Pat. No. 3,795,331 issued to Guest; U.S. Pat. No. 3,908,844 issued to Duffield; Vandewater, supra; Schremmer, supra; Hulsey, supra.

Of all of the foregoing, the following patents comprise devices used in fork lift application: Coleman, supra; Guest, supra; and Duffield, supra.

There are, incidentally, in the prior art several devices by which tines, or spears (14), or other work accessories are disposed rearward of the utility vehicle (100) employed such that they are effectually dragged across or in the ground. Except for Fortier, supra, applicant considers those too remote in concept for consideration herein.

The needs or objectives pointed out supra thus far remain only partly addressed in the prior art. Some have not been met at all.

SUMMARY OF THE INVENTION

The invention comprises a mechanism which permits certain implements or accessories attached to the loading bucket (101) of a utility vehicle (100) to be hydraulically projected forward out of the bucket (101) and retracted rearward back into it (101). Typically included as such are an array of spears (14) and an elastic scraper (23), both of which are in immobilized embodiments known to prior art. In providing versatility in projection and retraction of the accessories or assemblies, the loading bucket (101) may alternatively be employed for the traditional functions for which it (101) was originally designed without laborious disassembly.

The invention, thus, provides an array of spears (14) which may be projected forward of the loading bucket (101) and, after having dedicated them (14) to their (14) intended work, withdrawn out of the way so that the bucket (101) may be used as though the spears (14) were absent. The invention also, thus, provides a flexible scraper (23) for squeegee cleaning operation which may also be projected forward of the bucket for work and afterwards withdrawn into the bucket (101) substantially out of the way.

A combined variation is also provided which permits the mounting of an elastic scraper (23) upon a spear (14) array so that the same bucket (101) may economically be used for either of the two operations in addition to those for which buckets (101) are traditionally employed.

BRIEF DESCRIPTION OF THE DRAWINGS

Solid lines in the drawings represent the invention. Dashed lines represent prior art.

DESCRIPTION OF THE PREFERRED EMBODIMENT

Figure 1:
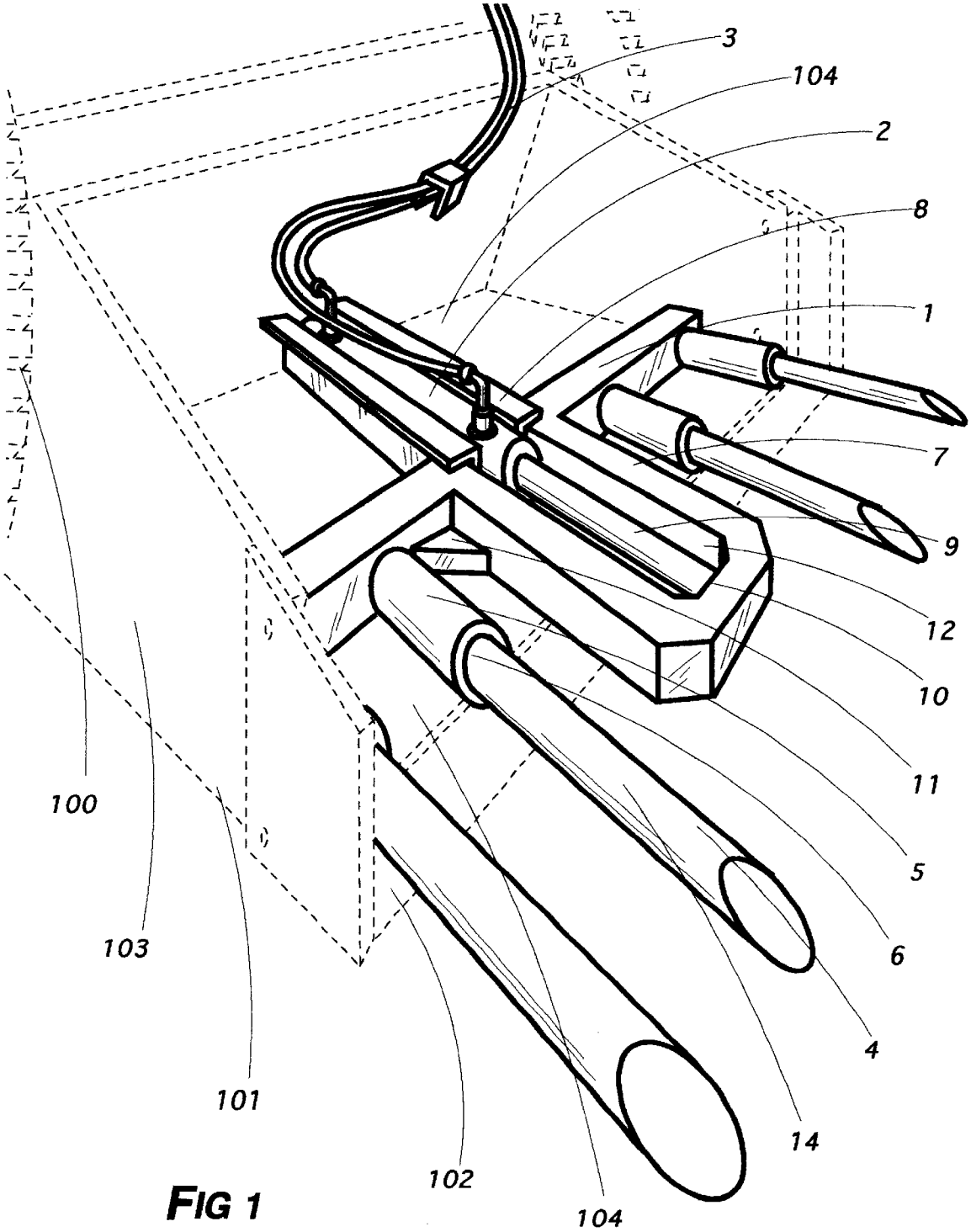
FIG. 1 represents a perspective view of the invention employed with an array of extenders (4) comprising spears (14) shown in projected disposition.
Figure 2:
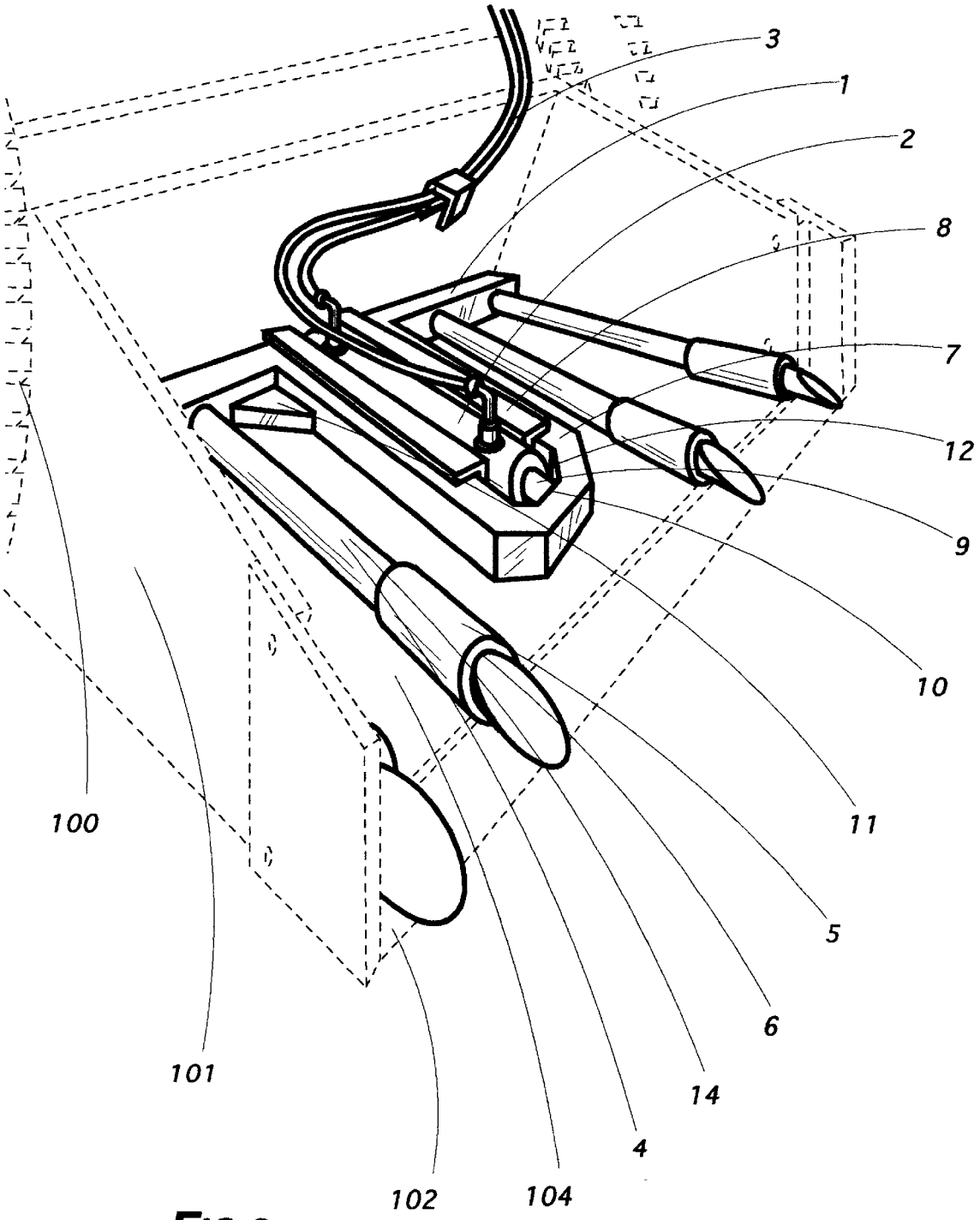
FIG. 2 depicts the same assembly in retracted disposition.

The invention comprises a projection and retraction assembly which, on the one hand, comprises an improvement to certain well known farm or construction vehicle (100) frontally disposed implements and, on the other, a combination of well known objects. The implements may comprise an array of spears (14) or an elastic scraper (23). Other implements, not immediately evident, may also be so used as part of the invention.

Considered as an improvement, the invention permits the utility accessory or appendage, whether a plurality of spears (14) or an elastic scraper (23), to be extended from the bucket (101) for its (14, 23, respectively intended use and afterwards withdrawn to its (14, 23, respectively) original station so that the bucket (101) can be used more or less as one (101) would be if no such appendage (14, 23) were present. The novelty, therefore, is in the projectability and retractability of the respective utility assembly (14, 23).

Considered as a combination of known objects, the invention comprises those configured and disposed as set forth ante.

Figure 3:
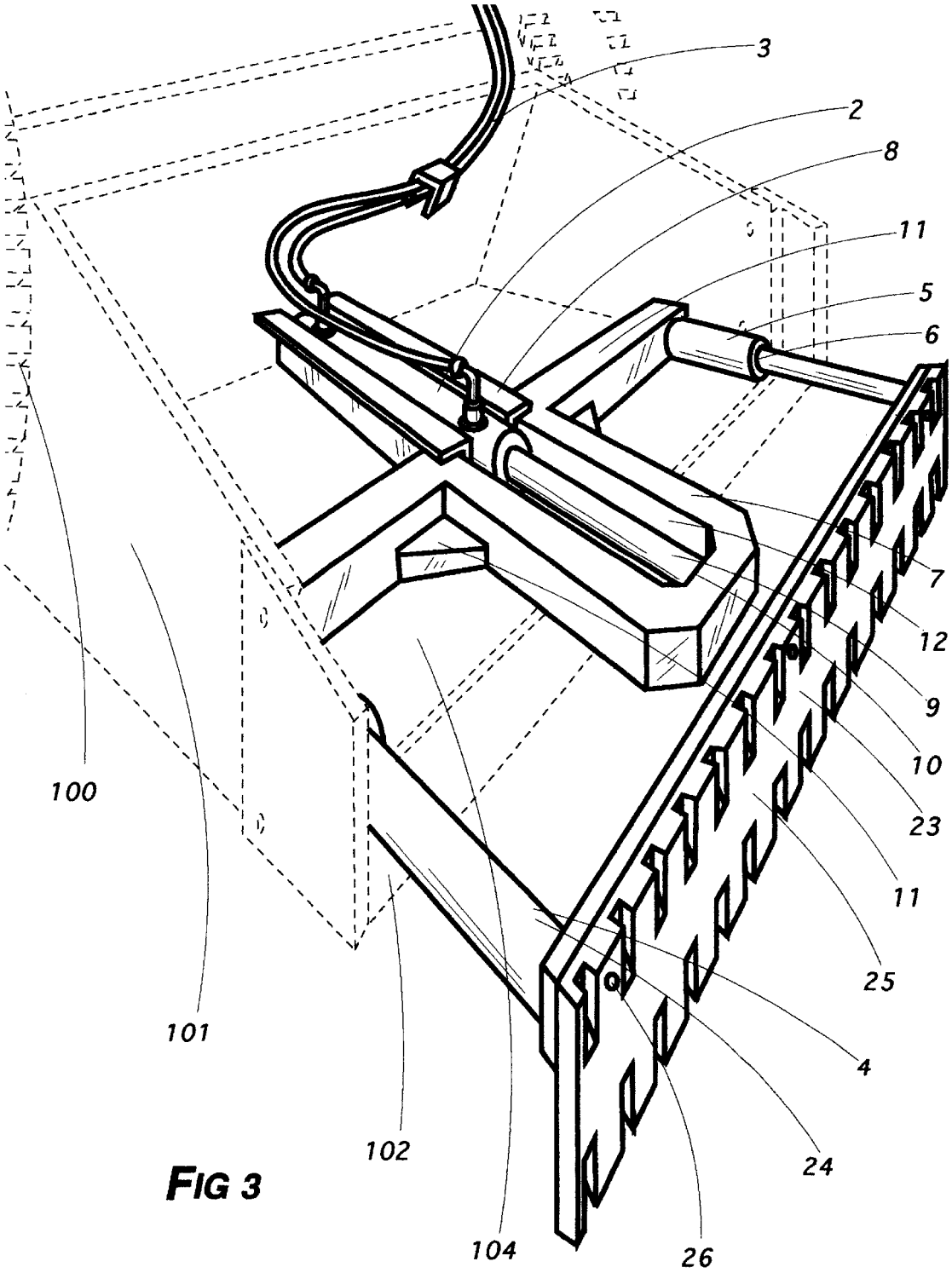
FIG. 3 comprises a perspective view of the invention employed with an elastic scraper (23) for squeegee-like operations, the scraper (23) being fixed in place by a pair of extenders (4) comprising scraper supports (24).
Figures 5, 6:
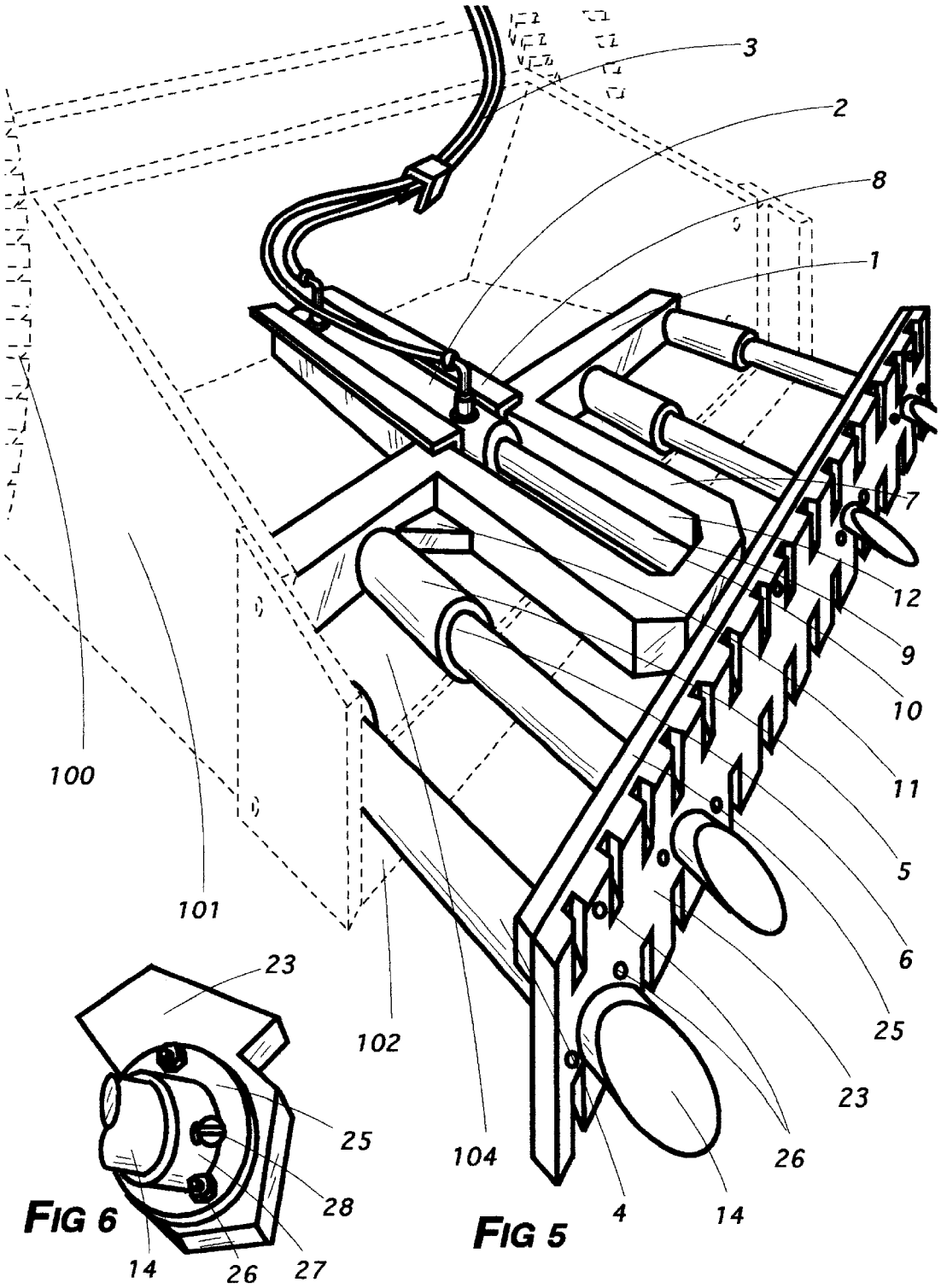
FIG. 5 illustrates employment of an elastic scraper (23) mounted upon a spear (14) array instead of upon scraper supports (24), a configuration made possible merely by cutting holes in the scraper (23) and providing suitable attachment means (25–28).
FIG. 6 comprises an example of hardware (25–28) employed to connect the FIG. 5 assembly to the spears (14).

As depicted in the embodiment shown in FIGS. 1–5, a moveable frame (1) is disposed within a loader bucket (101) such that a piston rod (9) comprised by a hydraulic cylinder (2) pushes it (1) forward to a position in front of the bucket (101)—as shown in the embodiments shown in FIGS. 1, 3 and 5—and pulls it (1) backward to a position within the bucket (101)—as shown in FIGS. 2, 4, 7 and 8.

The moveable frame (1) in some embodiments comprises merely a beam-like transverse character to which extenders are attached. It should be readily apparent that in such an embodiment, the frame (1) cannot be retracted any farther back than the front of the longitudinally disposed hydraulic cylinder (2) and, accordingly, cannot be made to occupy the rearmost part of the bucket (101). Preferably, therefore, the frame (1) is configured with a cylinder encompassing sector (7), more or less U shaped, to accommodate the cylinder (2). The configuration of the sector (7) is such as to provide a projection zone of clearance (12) which attains its (12) largest size when the piston rod (9) is projected to its (9) most forward position. FIGS. 1–5 comprise those elements. The embodiment shown in FIGS. 7 and 8 does so also in a configuration slightly different from the others.

In all of those embodiments, the foremost portion of the piston rod (9) is attached to the moveable frame (1) at a piston rod seat (10). The disposition is such that when the hydraulic cylinder (2) is operably engaged by manipulating a hand lever intended for such purpose, the piston rod (9) pushes the frame (1) forward out of the bucket (101) up to a distance equal to that the piston rod (9) is permitted to extend from the cylinder (2). Attachment of the piston rod (9) to the frame (1) at the site of the piston rod seat (10) may be accomplished by any known means but welding is the preferred one.

Angular convolutions in the frame (1) are preferably strengthened by one or more gussets (11), generally triangular shaped supports attached at joints otherwise vulnerable to bending or dislocation.

Figure 7:
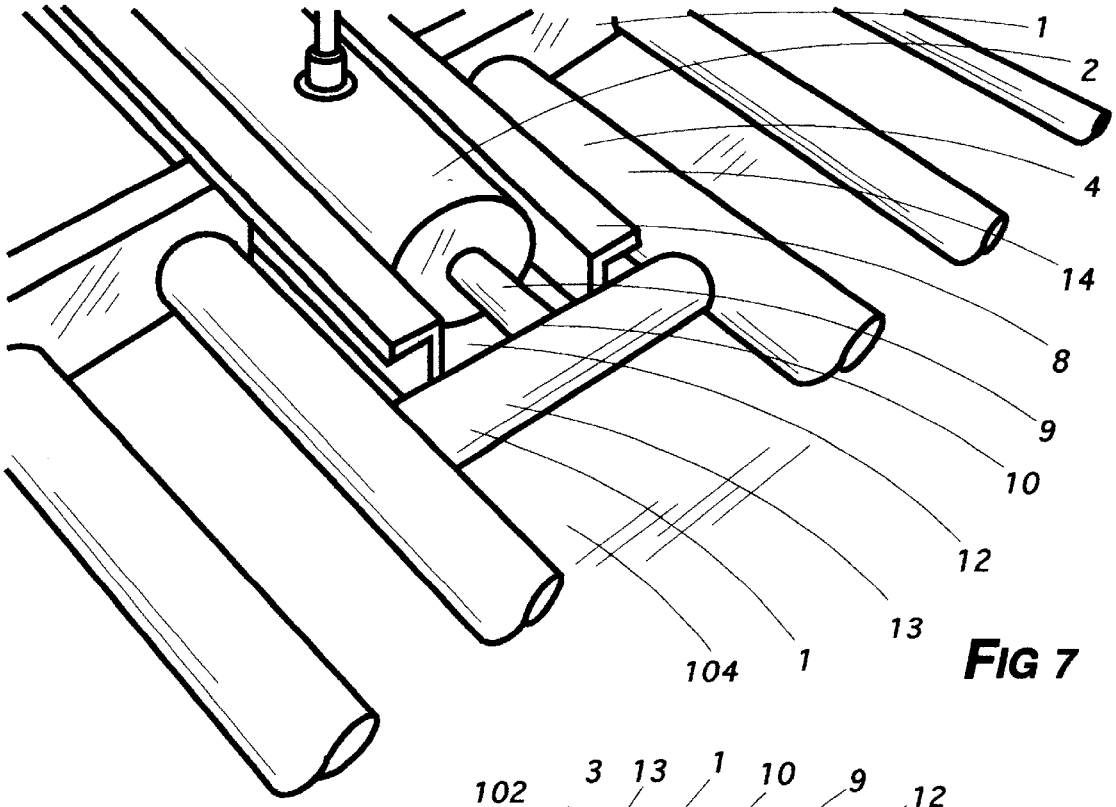
FIGS. 7 and 8 depict an embodiment—the former in cut-away perspective and the latter in overhead or plan view—comprising eight spears (14) in which part of the moveable frame (1) comprises an interspear brace (13) attached to the most central portion thereof (14).
Figure 8:
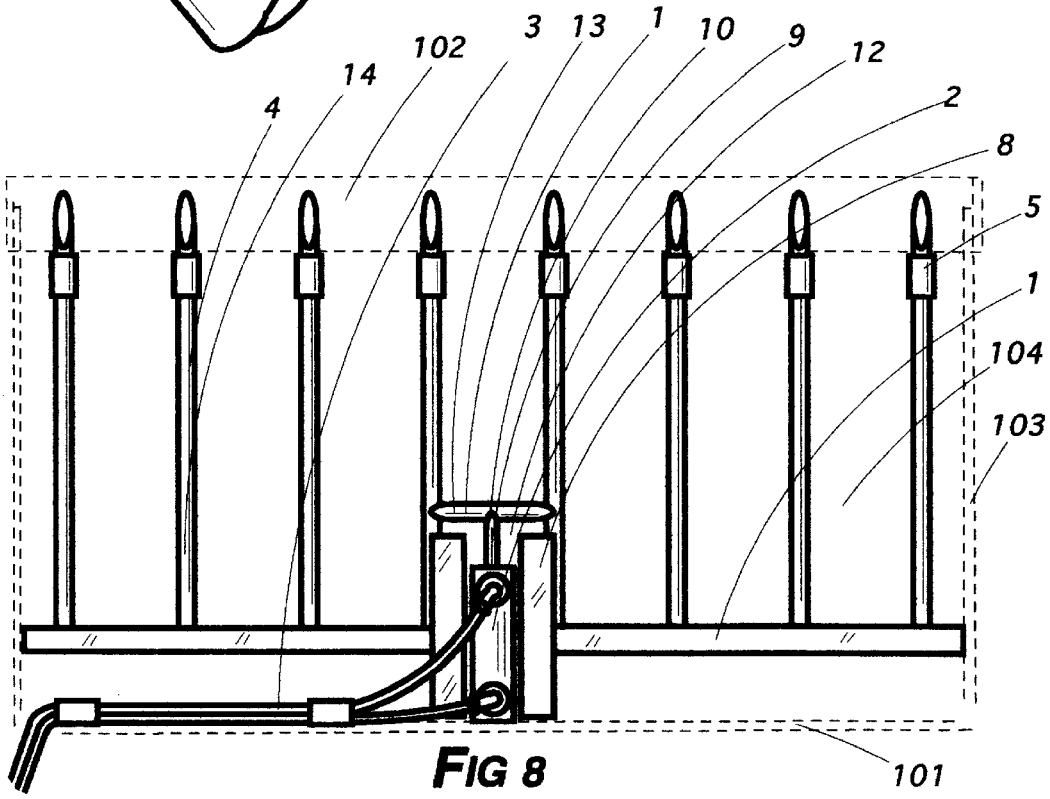

An interextender brace (13), when present, comprises a beam-like intermediary support transversely disposed between and attached to two adjacent extenders (4). While attachment may be by any known means, welding is preferred. By reason of its (13) disposition, the brace (13) provides lateral support to the extenders (4) it (13) is attached to. As a matter of convenience, the brace (13) may comprise the attachment site for the piston rod (9), as illustrated in FIGS. 7 and 8. In the embodiment shown in FIGS. 7 and 8, the interspear braces (13) also provide similar support.

The piston rod (9) is withdrawn into the cylinder (2) by appropriate hand lever operation, retracting the frame (1) back toward and, if desired, ultimately into the bucket (101).

The forward or backward movement of the frame (1) is restrained within one or more sector channel guides (8) during projection and retraction. The sector channel guides are shown in FIGS. 1–5, 7 and 8.

If properly configured, but a single sector channel guide (8) could suffice. The guide's (8) function is to permit the frame (1) to slide along its (8) length without becoming misaligned or otherwise dislodged. Were a single one (8) employed, it (8) would have to be shaped to laterally restrain the frame (1) during movement, move or less in the manner train wheels engage a rail. However, experience has shown that for the forces exerted in manipulating farm or construction loads, at least two guides (8) paired in parallel fashion are preferred. Where two or more sector channel guides (8) are employed, their lateral restraint upon the frame (1) is not literally one of engagement thereof (1) but rather, one merely of proximal disposition wherein their (8) placement is sufficiently close to a nearby portion of the frame (1) to precent its side-to-side movement.

It is conceivable the sides (103) of the bucket (101) may themselves (103) serve as sector channel guides (8), thereby simplifying the assembly's construction. It is again preferable, however, to dispose a pair of channel guides (8) at a site inboard from the sides (103). In most embodiments, the guides (8) are proximate the cylinder (2), lying in parallel opposition with it (2) so as to provide a nest for it (2) during the frame's (1) projection and retraction.

Thus, the cylinder (2) and each channel guide (8) are fixed, attached to the bucket (101), while the frame (1) and whatever is attached to it (1) are not.

Figure 4:
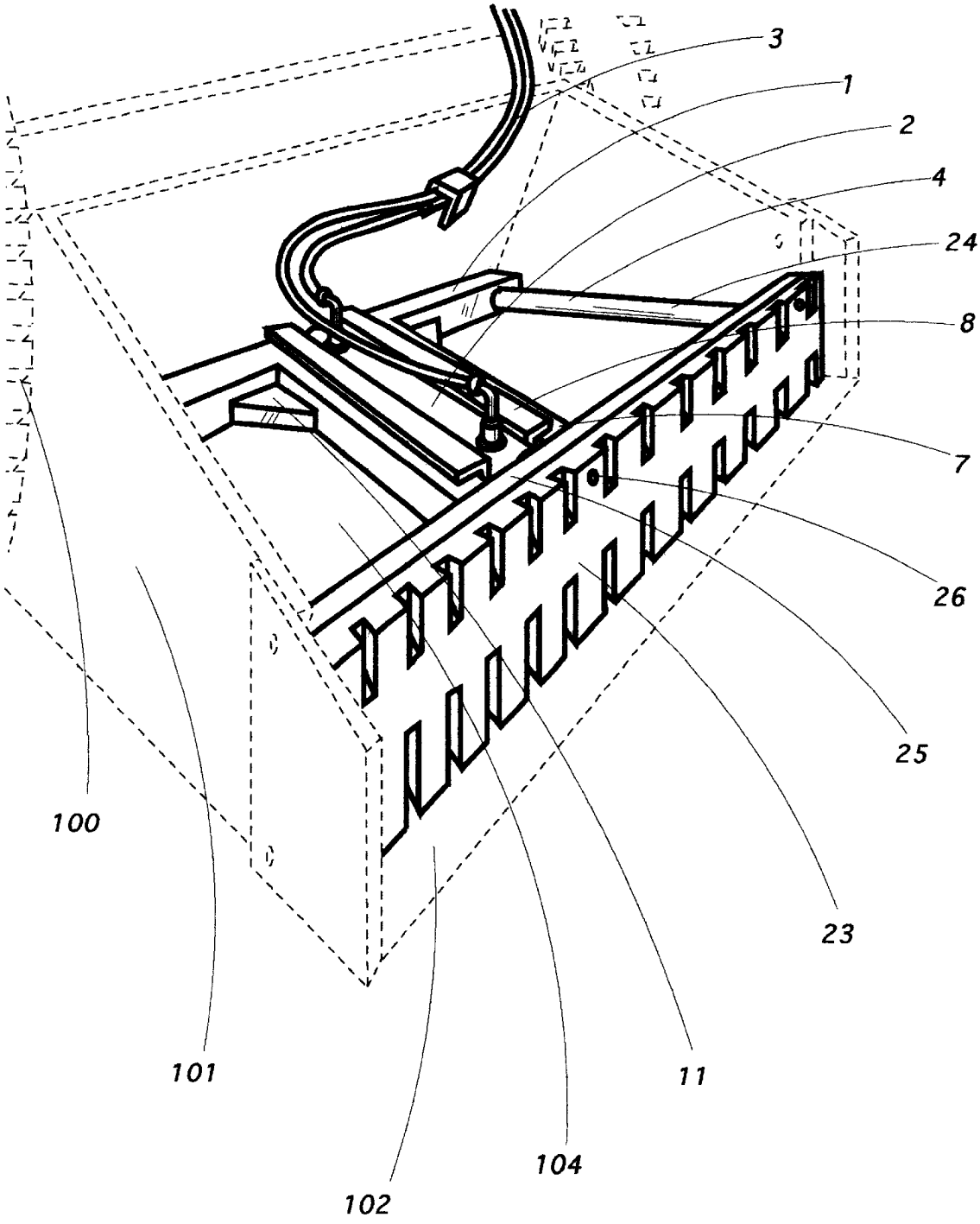
FIG. 4 depicts the same assembly in retracted disposition.

A plurality of extenders (4) are disposed forward of the frame (1). The character of the extender (4) depends upon that of the utility accessory or assembly. The minimum number of extenders (4) is two. For impaling type work of the kind associated with the lifting and transport of hay, manure or similar material, each extender (4) comprises a spear (14). FIGS. 1, 2, 7 and 8 illustrate such construction. Where elastic scraping—that is, squeegee type action—is intended, each extender (4) merely comprises scraper supports (24), elongated rod-like structures disposed to securely hold the scraper (23) in position, as shown in FIGS. 3 and 4. The spear (14)-like extenders of FIG. 5 also support a scraper (23), supra.

Whichever its nature, the extender (4) is attached at its (4) base to the front of the moveable frame (1) so as to orient it (4) in elongation in a forward direction.

One or more of the extenders (4) passes or slides through an extender guide (5) disposed to stabilize it (4) during forward and backward movement. Each guide (5) comprises an extender guide opening (6), through which the extender (4) emerges in a forward pointing direction. While merely one extender guide (5) might be considered to suffice, the presence of one (5) for each extender (4) enhances stability during operation. Such is the preferred configuration and that shown in FIGS. 1–5 and 8. Like the hydraulic cylinder (2) and the channel guides (8), they (5) are attached to the loading bucket (101).

Where a scraper (23) is connected to an array of spears (14) as in FIG. 5, special prior art means of connection must be employed to keep the scraper (14) from slipping off of the spears (14) while being moved backward across an underlying surface. The connection means (25–28) shown in FIG. 6, a merely exemplary one, requires that holes be cut in the scraper (23) through which the spears (14) are allowed to extend. The screws (28) may alternatively be disposed forward of the scraper (23) instead of behind it (23). If set screws (28) are employed, they (28) may be seated in small screw sockets drilled into the spears (14). Supporting rings (27) joined to scraper backing plates (25) connected to the scraper (23) by means of bolt and nut fasteners (26) are disposed as anchoring sites through which the set screws (28), if employed, may be fastened to the spears (14) so that they (14) are braced from both the front and rear of the scraper (23).

As a matter of summarizing clarification concerning the moving and nonmoving parts of the invention, the frame (1), extenders (4) and whatever type of accessory—whether an array of spears (14) or an elastic scraper (23)—is attached to it (1) are moveable in a forward and backward direction. The cylinder (2), sector channel guides (8) and extender guides (5) are fixed in place by attachment to the bucket (101), preferably along the bottom (104) or floor thereof (101).

The inventor hereby claims:

1. An implement projection and retraction assembly disposed within a loading bucket comprising two sides and a bottom and frontally connected to an utility vehicle, the assembly comprising:

a moveable frame;

a hydraulic piston cylinder supplied by reciprocal hydraulic feeder lines;

a plurality of spears each attached at its rear end to the moveable frame;

one or more sector channel guides longitudinally disposed on the bucket so as to restrain the moveable frame by reason of their proximal disposition from lateral movement while projected and retracted along the length thereof;

the moveable frame comprising in turn a piston rod seat;

the piston cylinder attached within the bucket and longitudinally disposed parallel each channel guide, the cylinder comprising in turn a piston rod disposed to project therefrom and retract thereinto, the projecting end thereof attached to the frame's piston rod seat;

whereby an utility vehicle operator may by empowering the hydraulic cylinder cause the moveable frame and attached spears by reason of their projection and retraction movement to impale a mass of material for transport to a selected locale.

2. An implement projection and retraction assembly disposed within a loading bucket comprising two sides and a bottom and frontally connected to an utility vehicle, the assembly comprising:

a moveable frame;

a hydraulic piston cylinder supplied by reciprocal hydraulic feeder lines;

a plurality of spears each attached at its rear end to the moveable frame;

an elastic scraper connected to the spears;

one or more sector channel guides longitudinally disposed on the bucket so as to restrain the moveable frame by reason of their proximal disposition from lateral movement while projected and retracted along the length thereof;

the moveable frame comprising in turn a piston rod seat;

the piston cylinder attached within the bucket and longitudinally disposed parallel each channel guide, the cylinder comprising in turn a piston rod disposed to project therefrom and retract thereinto, the projecting end thereof attached to the frame's piston rod seat;

whereby an utility vehicle operator may by empowering the hydraulic cylinder cause the moveable frame, attached spears and the elastic scraper connected to them, by reason of their projection and retraction movement to clean an underlying surface.

3. The implement projection and retraction assembly according to claim 1 wherein the number of sector channel guides is two disposed in parallel opposition to one another.

4. The implement projection and retraction assembly according to claim 3 wherein each channel guide is disposed proximate the cylinder.

5. The implement projection and retraction assembly according to claim 3 wherein each channel guide comprises one of the bucket sides.

6. The implement projection and retraction assembly according to claim 1 further comprising one or more extender guides, each disposed so that a spear passes through it;

whereby the moveable frame is further restrained from lateral movement during projection and retraction.

7. The implement projection and retraction assembly according to claim 6 wherein the number of extender guides is equal to that of the spears.

8. The implement projection and retraction assembly according to claim 5 wherein the situs of attachment of the extender guides, hydraulic piston cylinder and opposing sector channel guides is along the bucket floor.

9. The implement projection and retraction assembly according to claim 1 wherein the moveable frame comprises an U-shaped cylinder encompassing sector shaped to provide a zone of clearance wherein the cylinder and piston rod are disposed during the frame's projection and retraction.

10. The implement projection and retraction assembly according to claim 1 wherein the moveable frame comprises an interextender brace transversely disposed between and attached to two adjacent spears, the brace in turn comprising the frame's piston rod seat;

whereby intermediary support is provided for the spears.

* * * * *